US008007274B2

(12) United States Patent
Johnson et al.

(10) Patent No.: US 8,007,274 B2
(45) Date of Patent: Aug. 30, 2011

(54) FUEL NOZZLE ASSEMBLY

(75) Inventors: Thomas Edward Johnson, Greer, SC (US); Willy Steve Ziminsky, Simpsonville, SC (US); Benjamin Paul Lacey, Greer, SC (US); William David York, Greer, SC (US); Christian Xavier Stevenson, Inman, SC (US)

(73) Assignee: General Electric Company, Schenectady, NY (US)

( * ) Notice: Subject to any disclaimer, the term of this patent is extended or adjusted under 35 U.S.C. 154(b) by 424 days.

(21) Appl. No.: 12/249,158

(22) Filed: Oct. 10, 2008

(65) Prior Publication Data

US 2010/0089367 A1 Apr. 15, 2010

(51) Int. Cl.
*F23N 1/10* (2006.01)

(52) U.S. Cl. ..... 431/40; 431/12; 431/22; 431/33; 431/37; 431/198; 431/199; 431/284; 251/237; 251/343; 251/344; 222/300; 222/499; 222/513; 222/522

(58) Field of Classification Search ..... 431/12, 431/22, 33, 37, 198, 199, 284, 40; 251/237, 251/343, 344; 222/300, 499, 513, 522
See application file for complete search history.

(56) References Cited

U.S. PATENT DOCUMENTS 1,662,416 A * 3/1928 Claus ..... 236/15 A
1,764,659 A * 6/1930 Stokes ..... 123/179.15
1,963,957 A * 6/1934 Cunningham ..... 431/78
1,977,192 A * 10/1934 Lindemann et al. ..... 431/40
2,513,720 A * 7/1950 Hallinan ..... 239/75
2,531,015 A * 11/1950 Thompson ..... 431/243
2,589,804 A * 3/1952 Harris et al. ..... 431/78
2,663,142 A * 12/1953 Wilson ..... 60/761
2,837,893 A * 6/1958 Schirmer ..... 60/39.23
2,869,630 A * 1/1959 Flynn ..... 431/280
2,930,192 A * 3/1960 Johnson ..... 60/746
2,935,126 A * 5/1960 Kaczenski ..... 431/116
3,066,727 A * 12/1962 Galvin ..... 431/63
3,726,475 A * 4/1973 Eising ..... 236/102
3,776,456 A * 12/1973 Eising ..... 236/93 R
4,080,153 A * 3/1978 Wolfe ..... 431/42
4,230,410 A * 10/1980 Kastl et al. ..... 366/178.2
4,525,138 A * 6/1985 Snyder et al. ..... 431/187
5,131,840 A * 7/1992 Zettner ..... 431/353
5,235,814 A 8/1993 Leonard
5,240,409 A * 8/1993 Xiong ..... 431/189
5,738,077 A * 4/1998 Kim ..... 123/585
6,623,267 B1 * 9/2003 Golladay, Jr. ..... 431/285
6,772,958 B1 * 8/2004 Lamb et al. ..... 236/34.5
6,817,416 B2 * 11/2004 Wilson et al. ..... 166/332.1
7,197,879 B2 4/2007 Buehman et al.
7,204,434 B2 * 4/2007 Pasquali et al. ..... 239/585.4
(Continued)

*Primary Examiner* — Kenneth B Rinehart
*Assistant Examiner* — Jorge Pereiro
(74) *Attorney, Agent, or Firm* — Cantor Colburn LLP

(57) ABSTRACT

A fuel nozzle assembly is provided. The assembly includes an outer nozzle body having a first end and a second end and at least one inner nozzle tube having a first end and a second end. One of the nozzle body or nozzle tube includes a fuel plenum and a fuel passage extending therefrom, while the other of the nozzle body or nozzle tube includes a fuel injection hole slidably aligned with the fuel passage to form a fuel flow path therebetween at an interface between the body and the tube. The nozzle body and the nozzle tube are fixed against relative movement at the first ends of the nozzle body and nozzle tube, enabling the fuel flow path to close at the interface due to thermal growth after a flame enters the nozzle tube.

15 Claims, 3 Drawing Sheets

U.S. PATENT DOCUMENTS 7,445,424 B1 * 11/2008 Ebert et al. ..... 415/113
7,566,217 B2 * 7/2009 Morsner ..... 431/12
2007/0001033 A1 * 1/2007 Pasquali et al. ..... 239/585.5
2007/0026279 A1 * 2/2007 Hirsch et al. ..... 429/22

* cited by examiner

FUEL NOZZLE ASSEMBLY

FEDERAL RESEARCH STATEMENT

This invention was made with the Government support under Contract No. DE-FC26-05NT42643, awarded by the Department of Energy. The Government has certain rights in this invention.

BACKGROUND OF THE INVENTION

The subject matter disclosed herein relates to fuel nozzles and more particularly to a nozzle which shuts off fuel feed if a flame enters the nozzle.

The majority of pre-mix fuel nozzle builds are designed to pre-mix natural gas fuel. Today there is an emphasis on designing and building fuel nozzles that burn a hydrogen fuel. Hydrogen fuel is much more reactive, and thus, has a much higher flame speed. When designing fuel nozzles for pre-mixed combustion systems, the air and fuel are introduced upstream of where the combustion process takes place. Generally, fuel nozzles are designed to flow air through them at a rate that is faster than the flame can propagate upstream. When the fuel used is hydrogen, it is much more difficult to keep the flame out of the fuel nozzle. If the flame "flashes back" into the pre-mixer for any length of time it will destroy the fuel nozzle, since the flame temperature is almost always higher than the melting temperatures of the nozzle parts. If a nozzle cannot reliably keep the flame out of the fuel nozzle, other alternatives must be considered.

Flashback damage has historically been detected using NOx emission and exhaust temperature spreads as indicators. When a flashback occurs, NOx increases and exhaust temperature spreads often, but not always, increase. The NOx increase is typically proportional to the severity of the flashback. Further, the exhaust temperature spread change can vary, either decreasing or increasing, depending upon the state of the combustors, which suffer flashback, prior to the flashback event. The unpredictable behavior of exhaust temperature spreads, coupled with the emissions data scatter, has made it difficult to determine whether or not a flashback has occurred using NOx and exhaust spread indicators. Therefore, methods which rely on changes in NOx and exhaust profile over sequential instants of time to determine if a flashback has occurred are ineffective.

Other methods for detecting flashback events in gas turbines include periodic reference point checks to determine whether or not flashback damage has occurred. The method relies on the repeatability of exhaust profile and NOx as functions of turbine conditions. In combination with experience-based limits, changes in these values are used to determine if a flashback has occurred, even days later. This does not help determine a flashback event at the instant it occurs.

Normally, it would be advantageous for a flash back event to be actively extinguished when it occurs. This requires first sensing the flashback event and, when detected, turning off a valve and then re-starting the fuel flow after the flame goes out. As discussed above, the process of first sensing the flashback event is an unreliable or slow process. Even were it possible to instantly detect flashback, it is still necessary to turn off fuel flow to the nozzle. If the flashback event is not corrected in a very short period of time, or if the flashback causes a flame holding event within the nozzle, the nozzle can be irreparably damaged or destroyed.

The cost of adding flashback sensing equipment, control equipment and control valves to each nozzle is expensive. In addition it is not practical to implement a control system on many individual injectors, which it is expected will be required in order to consistently burn hydrogen rich fuels. If these facts are coupled with the inability to accurately and quickly sense a flashback event, it is clear that another alternative is required.

BRIEF DESCRIPTION OF THE INVENTION

According to one aspect of the invention, a fuel nozzle assembly is provided. The assembly includes an outer nozzle body having a first end and a second end and at least one inner nozzle tube having a first end and a second end. One of the nozzle body or nozzle tube includes a fuel plenum and a fuel passage extending therefrom, while the other of the nozzle body or nozzle tube includes a fuel injection hole slidably aligned with the fuel passage to form a fuel flow path therebetween at an interface between the body and the tube. The nozzle body and the nozzle tube are fixed against relative movement at the first ends of the nozzle body and nozzle tube.

According to another aspect of the invention, a method of passively extinguishing the fuel feed to a fuel nozzle if a flame enters the nozzle is provided. It includes an outer nozzle body having a first end and a second end, at least one inner nozzle tube having a first end and a second end and one of the nozzle body or the nozzle tube including a fuel plenum and a fuel passage extending therefrom. The other of the nozzle body or nozzle tube includes a fuel injection hole adjacent the fuel passage to form a fuel flow path therebetween at an interface between the body and the tube. The method comprises fixing the nozzle body and the nozzle tube against relative movement at the first ends, allowing either the nozzle tube or nozzle body to slide relative to the other in response to a flame entering the nozzle tube, and closing the fuel flow path at the interface to extinguish the flame.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

The present invention of a passive fuel extinction and nozzle is intended to shut off the fuel feed supplied to the fuel nozzle if a flame enters the nozzle. While one end of the nozzle body and nozzle tube is fixed, the opposite end is free to grow due to thermal expansion caused by the flame. The thermal growth causes one of the fuel injection orifice (or hole) to translate relative to the gas passage from a position generally in alignment that forms a fuel flow path therebetween. When the orifice and passage translate out of alignment, gas injection is blocked between the fuel plenum and the interior of the nozzle. As a result, the flame will go out.

Figure 1:
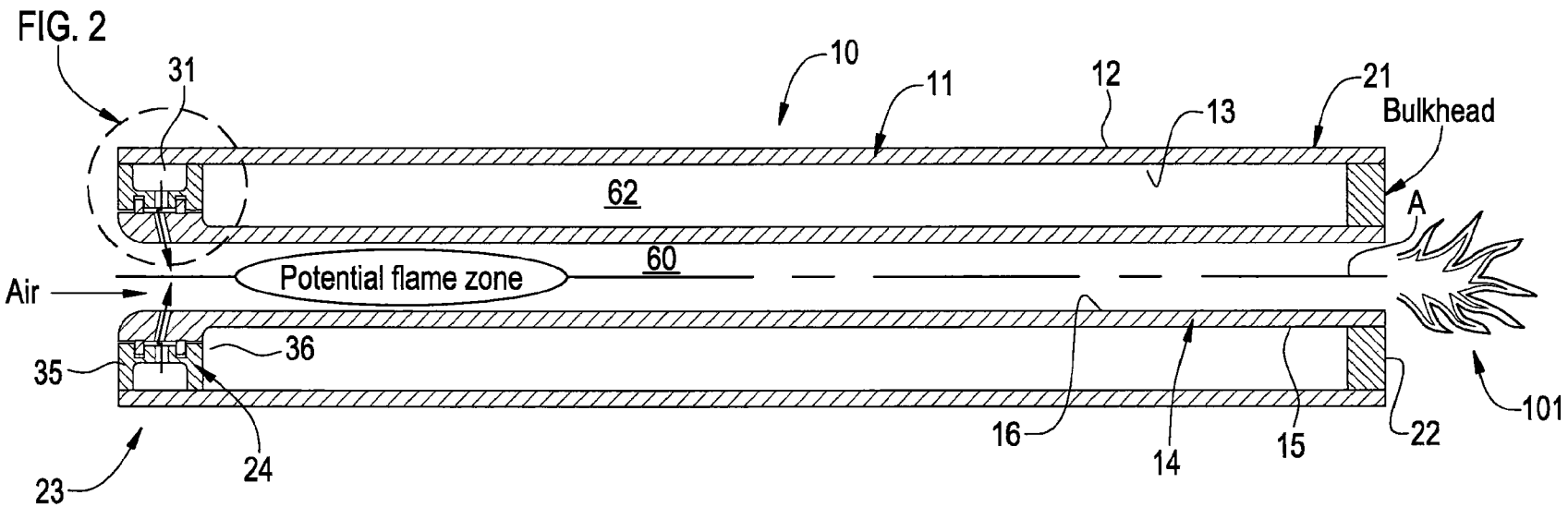
FIG. 1 is a cross-sectional view of the fuel nozzle assembly of the present invention.

Referring now to FIG. 1, where the invention will be described with reference to specific embodiments, without limiting same, a cross-section through a fuel nozzle 10 is shown. Fuel nozzle 10 includes an outer nozzle body 11 having an outer circumferential surface 12 and an inner circumferential surface 13. Fuel nozzle, 10 also includes an inner nozzle tube 14 having an outer circumferential surface 15 and an inner circumferential surface 16. Tubes 11 and 14 extend axially along a centerline A and are concentrically held in place at an aft end 21 by bulkhead 22.

The fuel is injected into fuel nozzle 10 at a front end 23. A manifold plate 24 is rigidly connected to the inner circumferential surface 13 of outer nozzle body 11. Located within the manifold plate 24, and shown circumferentially, is a fuel plenum 31. A fuel passage 32 extends from fuel plenum 31 to an interface 33 between nozzle body 11 and nozzle tube 14. A series of openings 34 extend through manifold plate 24 between an exterior side 35 and an interior side 36 forming an annular ring 37. An annular groove 41 extends radially from the centerline of opening 34 and between the sides 35 and 36 to form a fuel pocket. Deeper annular grooves, 42 and 43 are machined in annular ring 37, annular groove 42 is disposed between exterior side 35 and groove 41, while annular groove 43 is disposed between groove 41 and interior side 36.

Piston rings 52 and 53 are located within grooves 42 and 43 respectively, and frictionally engage a translating surface 54 of nozzle tube 14 opposite annular ring 37 at interface 33. Translating surface 54 forms the outermost circumferential surface of a flange portion 55 of nozzle tube 14. Located within flange portion 55 is a fuel injection hole (or orifice) 56. As shown, fuel injection hole is placed to direct fuel at an angle relative to the interior mixing zone (or potential flame zone) 60 of the nozzle tube 14. It will be appreciated that fuel injection hole 56 may be placed at any orientation to meet the requirements of the overall combustion system. The end face 61 of flange portion 55 flares outwardly from interior mixing zone 60 so that nozzle tube 14 may maintain contact with an air source, even during thermal expansion of tube 14. It will be understood that thermal expansion of tube 14 will result in some non-uniform movement of the end face 61 of flange portion 55 due to uneven propagation of temperatures from interior mixing zone 60 to end face 61.

In normal operation air is injected into nozzle tube 14 at end face 61, while fuel is injected into fuel plenum 31, whereby it fluidly flows through fuel passage 32, into the fuel pocket formed by annular groove 41, and then through fuel injection orifice 56 into the interior mixing zone 60 of tube 14. Therein air and fuel are mixed and are expelled into the intended burning region 101. In order that burning happen at the intended burning region 101, nozzles are designed to flow air through them at a rate that is faster than the flame can propagate upstream. However, when using hydrogen keeping the flame out of the fuel nozzle is difficult. When this happens, a flame flashes back into the interior mixing zone 60 of nozzle tube 14. Over time, or if a flame holds within interior mixing zone 60, the flame will destroy the fuel nozzle since flame temperatures are higher than the melting temperatures of the parts.

Figure 2:
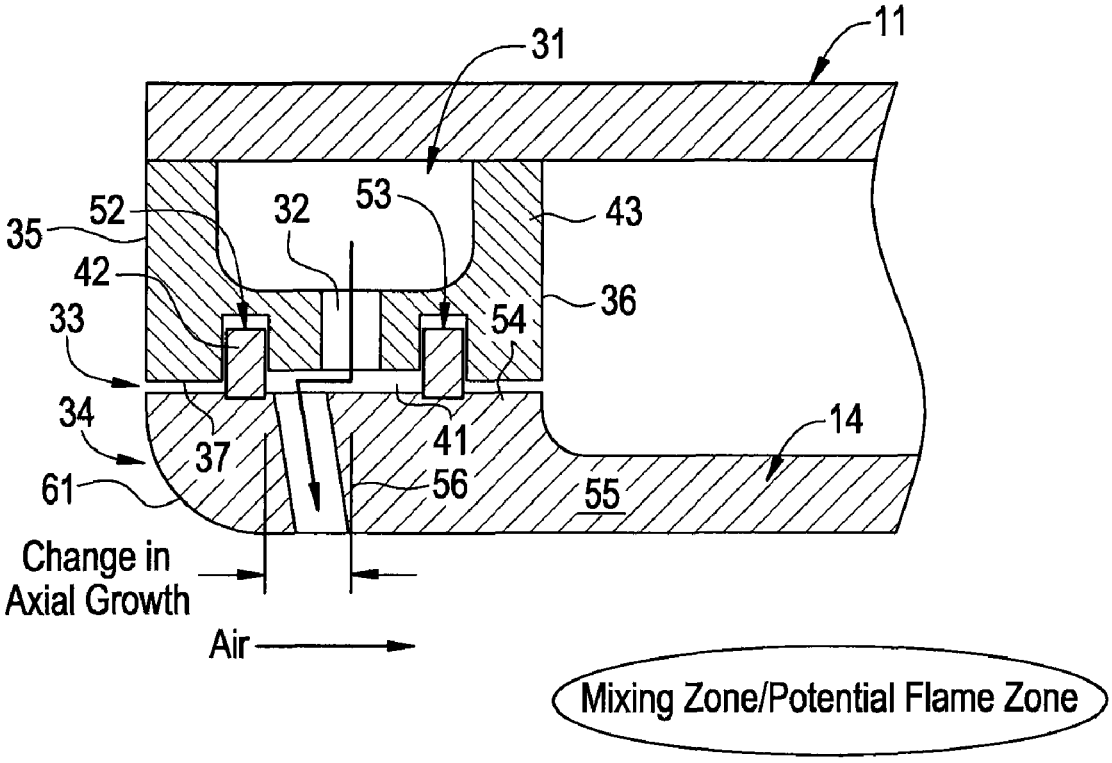
FIG. 2 is a detailed view of the area labeled FIG. 2 from FIG. 1.

When a flame enters interior mixing zone 60, tube 14 will heat up. An annular insulation space 62 between nozzle tube 14 and nozzle body 11 keeps nozzle body 11 from heating up in a like manner. The heating process caused by a flame in interior mixing zone 60 can drive the temperature from a normal operation of about 800° F. to as high as 4000° F. Natural thermal expansion then causes nozzle tube 14 to grow relative to nozzle body 11. Since both nozzle body 11 and nozzle tube 14 are fixed at bulkhead 22, but not fixed at interface 33, flange portion 55 of nozzle tube 14 translates in a generally axial manner, shown as "Change in Axial Growth" when referring to FIG. 2. Fuel injection hole 56 then translates into contact, or even past piston rings 52, effectively shutting off fuel flow to interior flame zone 60. Once fuel flow to fuel injection hole 56 is sealed, the fire is naturally extinguished due to lack of fuel. After the flame goes out, nozzle tube 14 thermally contracts back to the operating state of fuel nozzle 10, thus reopening the fuel flow path between fuel plenum 31 and interior flame zone 60.

The design of the present invention utilizes a passive mechanism to cut off fuel to nozzle tube 14 when it gets hot, while still providing a seal to prohibit fuel gases from leaking into unwanted areas of the nozzle assembly. The seal for the fuel flow path between fuel plenum 31 and interior mixing zone 60 is provided by piston rings 52 and 53, which are captured in grooves 42 and 43, respectively and are allowed to frictionally engage and slide along translating surface 54 at interface 33.

Figure 3:
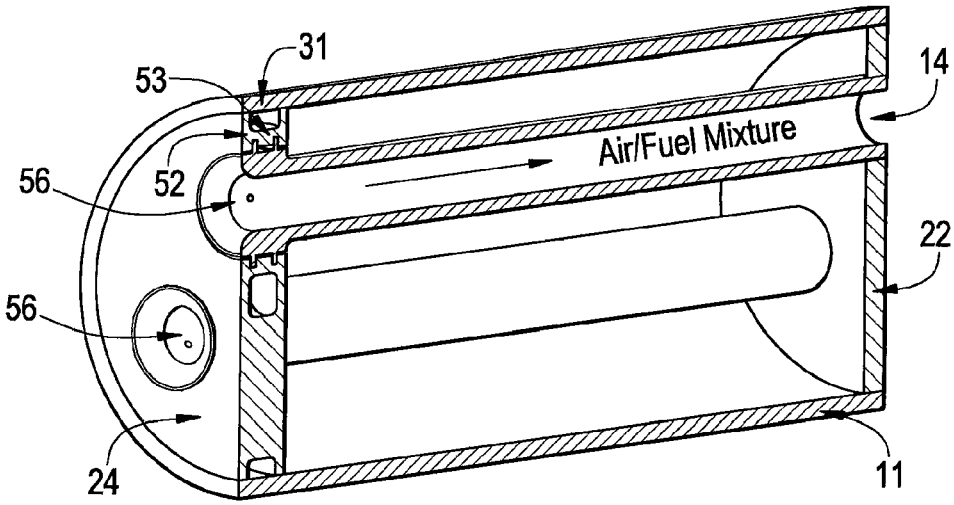
FIG. 3 is an isometric view, taken in cross-section, of the nozzle assembly of the present invention.
Figure 4:
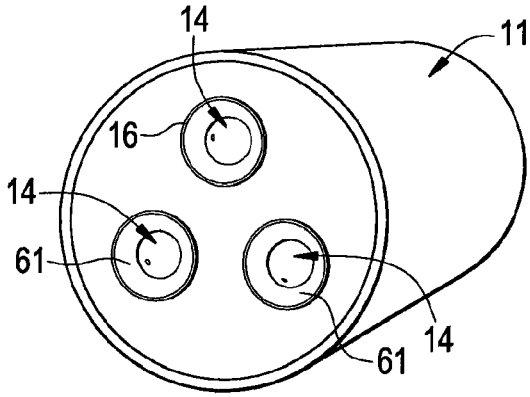
FIGS. 4 and 5 are front and aft isometric views of the fuel nozzle assembly of the present invention.
Figure 5:
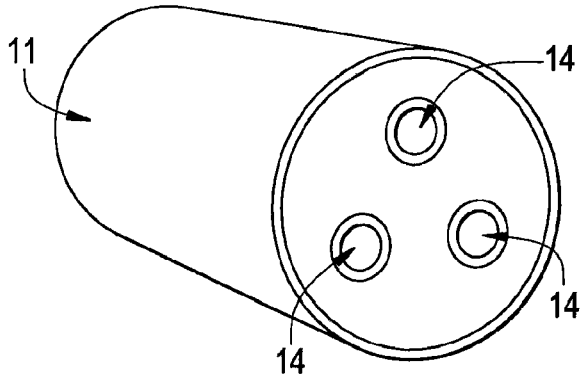

It will be appreciated that the design of the present invention may incorporate any number of nozzle tubes 14 within the fuel nozzle assembly 10. As shown in FIGS. 3A-3C, three nozzle tubes are contained within a singular nozzle body 11 each nozzle tube being injected with an air fuel mixture as described hereinabove. When a flame enters interior mixing zone 60 of any one of the nozzle tubes 14, fuel to that individual nozzle will be shut off until the nozzle tube thermally contracts to a normal operating state. It will be further appreciated that nozzle tubes 14 can be built into any size assembly that is necessary, and may comprise an unlimited number of nozzle tubes within nozzle body 11. The present invention also allows for easy individual replacement of a nozzle tube 14 if it is damaged due to thermal distress from long-term exposure to heat cycles.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel nozzle comprising:

an outer nozzle body having a first end and a second end, said nozzle body having a manifold plate with a fuel plenum therein and having a fuel passage extending therefrom;

an inner nozzle tube having a first end and a second end, said nozzle tube including a fuel injection hole slidably aligned and in fluid communication with said fuel passage at an interface between said body and said tube, said nozzle body and said nozzle tube fixed against relative movement at said first ends; and one of said nozzle tube or nozzle body including an annular groove on a circumferential face of one of said nozzle body or nozzle tube interposed and in fluid communication with said fuel passage and said fuel injection hole.

2. A fuel nozzle assembly comprising:

an outer nozzle body having a first end and a second end;

at least one inner nozzle tube having a first end and a second end;

one of said nozzle body or nozzle tube including a fuel plenum and a fuel passage extending therefrom;

the other of said nozzle body or nozzle tube including a fuel injection hole movably aligned with said fuel passage to form a fuel flow path therebetween at an interface between said nozzle body and said at least one nozzle tube, said nozzle body and said at least one nozzle tube fixed against relative movement at respective said first ends, including sealing members located adjacent said fuel passage and said fuel injection hole for isolating said fuel flow path.

3. The fuel nozzle assembly of claim 2, wherein said nozzle body includes said fuel plenum and said fuel passage.

4. The fuel nozzle assembly of claim 3, wherein said nozzle body and said at least one nozzle tube are fixed to a bulkhead.

5. The fuel nozzle assembly of claim 2, wherein said nozzle body and said at least one nozzle tube are fixed to a bulkhead at said first ends.

6. The fuel nozzle assembly of claim 2, wherein said interface includes a fuel pocket on a circumferential face of one of said nozzle body or said at least one nozzle tube interposed and in fluid communication with said fuel passage and said fuel injection hole.

7. A fuel nozzle assembly comprising:

an outer nozzle body having a first end and a second end;

at least one inner nozzle tube having a first end and a second end;

one of said nozzle body or nozzle tube including a fuel plenum and a fuel passage extending therefrom;

the other of said nozzle body or nozzle tube including fuel injection hole movably aligned with said fuel passage to form a fuel flow path therebetween at an interface between said nozzle body and said at least one nozzle tube, said nozzle body and said at least one nozzle tube fixed against relative movement at respective said first ends, wherein said interface includes an inner circumferential face of said nozzle body, a corresponding outer circumferential face of said at least one nozzle tube and sealing members for isolating said fuel flow path.

8. The fuel nozzle assembly of claim 7, wherein said inner circumferential face includes annular grooves adjacent said fuel passage to receive said sealing members therein, that frictionally engage said outer circumferential face.

9. The fuel nozzle assembly of claim 8, wherein said sealing members are piston rings.

10. A fuel nozzle assembly comprising:

an outer nozzle body having a first end and a second end;

at least one inner nozzle tube having a first end and a second end;

one of said nozzle body or nozzle tube including a fuel plenum and a fuel passage extending therefrom;

the other of said nozzle body or nozzle tube including a fuel injection hole movably aligned with said fuel passage to form a fuel flow path therebetween at an interface between said nozzle body and said at least one nozzle tube, said nozzle body and said at least one nozzle tube fixed against relative movement at respective said first ends, wherein said interface includes a fuel pocket on a circumferential face of one of said nozzle body or said at least one nozzle tube interposed and in fluid communication with said fuel passage and said fuel injection hole.

11. A method of passively extinguishing the fuel feed to a fuel nozzle, including an outer nozzle body having a first end and a second end, at least one inner nozzle tube having a first end and a second end, one of said nozzle body or said nozzle tube including a fuel plenum and a fuel passage extending therefrom, the other of said nozzle body or nozzle tube including a fuel injection hole adjacent said fuel passage to form a fuel flow path therebetween at an interface between said body and said tube; the method comprising:

fixing said nozzle body and said nozzle tube against relative movement at said first ends, allowing said nozzle tube to move relative to said nozzle body in response to a flame entering said nozzle tube; and closing said fuel flow path at said interface to extinguish a flame.

12. The method of claim 11, further comprising, allowing said nozzle tube to cool;

allowing said nozzle tube to slide relative to said nozzle body; and opening said fuel flow path at said interface to allow fuel injection into said nozzle.

13. The method of claim 11, including isolating said fuel flow path by providing sealing members disposed adjacent said fuel passage and said fuel injection hole.

14. The method of claim 11, including providing an annular groove on a circumferential face of one of said nozzle body or nozzle tube in fluid communication between said fuel passage and said fuel injection hole and sealing said fuel flow path at said interface.

15. The method of claim 11, including providing sealing members front and aft of said fuel passage, wherein said sliding step moves said fuel injection hole relative to said fuel passage into sealing engagement with one of said sealing members.

* * * * *

UNITED STATES PATENT AND TRADEMARK OFFICE

CERTIFICATE OF CORRECTION

PATENT NO. : 8,007,274 B2
APPLICATION NO. : 12/249158
DATED : August 30, 2011
INVENTOR(S) : Thomas Edward Johnson et al.

It is certified that error appears in the above-identified patent and that said Letters Patent is hereby corrected as shown below:

Title Page, Item (75) Inventors: Delete "Lacey" and insert -- Lacy --.

Signed and Sealed this
Eighth Day of May, 2012

David J. Kappos

David J. Kappos
*Director of the United States Patent and Trademark Office*